US006796524B2

(12) United States Patent
Pollock et al.

(10) Patent No.: US 6,796,524 B2
(45) Date of Patent: Sep. 28, 2004

(54) REVERSIBLE ANGLE BAR FOR A WEB PRINTING PRESS

(75) Inventors: David Clarke Pollock, Somersworth, NH (US); Jatinder Singh Sappal, Rochester, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 19 days.

(21) Appl. No.: 10/294,356

(22) Filed: Nov. 14, 2002

(65) Prior Publication Data

US 2004/0094657 A1 May 20, 2004

(51) Int. Cl.[7] ..... B65H 23/32

(52) U.S. Cl. ..... 242/615.12; 242/615.21; 226/21; 226/174; 226/196.1

(58) Field of Search ..... 242/615.12, 615.21; 226/196.1, 19, 21, 174

(56) References Cited

U.S. PATENT DOCUMENTS 3,125,268 A * 3/1964 Bartholomay ..... 242/615.12
5,100,117 A * 3/1992 Hajek et al. ..... 270/52.08
5,316,199 A * 5/1994 Hansen et al. ..... 242/615.12
5,464,143 A 11/1995 Hansen ..... 226/199
5,520,317 A * 5/1996 Eckert et al. ..... 242/615.12
6,450,382 B1 * 9/2002 Ohno ..... 226/21
6,666,399 B2 * 12/2003 Perdu ..... 242/615.12

FOREIGN PATENT DOCUMENTS

DE 10164256 8/2002

* cited by examiner

*Primary Examiner*—Kathy Matecki
*Assistant Examiner*—Evan Langdon
(74) *Attorney, Agent, or Firm*—Davidson, Davidson & Kappel, LLC

(57) ABSTRACT

A reversible angle bar device for a web printing press having a web with an entering web centerline has a support, a first angle bar portion angled with respect to the first entering web centerline on a first side of the entering web centerline, and a second angle bar portion angled with respect to the entering web centerline and being located on a second side of the entering web centerline opposite the first side, the first and second angle bar portions being fixed to the support. A moveable angle bar portion is selectively attachable to either the first angle bar portion or the second angle bar portion.

12 Claims, 6 Drawing Sheets

REVERSIBLE ANGLE BAR FOR A WEB PRINTING PRESS

BACKGROUND INFORMATION

The present invention relates generally to printing presses and more particularly to angle bars for web printing presses.

U.S. Pat. No. 5,464,143 discloses a width adjustable angle bar assembly for a printing press. The adjustable angle bar assembly has a support and a hollow angle bar pivotally mounted adjacent a central portion of the angle bar. The angle bar may be moved between first and second separate positions approximately ninety degrees apart. As shown in the figures, the support and pivot point for the angle bar is off-center from the web, so that reversal of the angle bar requires realignment of the web to a new centerline.

BRIEF SUMMARY OF THE INVENTION

An object of the present invention is to provide a reversible angle bar device in which the centerline of the web does not vary in either position of the angle bar. Another alternate or additional object of the present invention is to provide a reversible angle bar which is easy to reverse.

The present invention provides a reversible angle bar device for a web printing press having a web with an entering web centerline. The angle bar device includes a support, a first angle bar portion angled with respect to the first entering web centerline on a first side of the entering web centerline, a second angle bar portion angled with respect to the entering web centerline and being located on a second side of the entering web centerline opposite the first side, the first and second angle bar portions being fixed to the support, and a moveable angle bar portion selectively attachable to either the first angle bar portion or the second angle bar portion.

By providing a movable angle bar portion and two fixed angled angle bar portions, a reversible angle bar device may be provided in which the web centerline does not vary relative to a support centerline. A robust design with high accuracy, speed and repeatability is thus also possible.

Preferably, the first angle bar portion has an angle of 45 degrees to the entering web centerline, as does the second angle bar portion, the first and second angle bar portions thus being angled at 90 degrees to one another.

The first and second angle bar portions preferably are symmetric to one another about the entering web centerline.

The moveable angle bar portion may be attached to either the first or second angle bar portion in an air-tight manner using for example a sliding fit, a screw fit, or a self-locking mechanism. An air supply is connected to both the first and the second angle bar portions.

The support may be movable.

The angle bar device thus provides a first exiting web position and a second exiting web position in which the first exiting web centerline and the second exiting web centerlines are the coextensive. An effective pivot point of the two angle bar positions thus may be defined, the pivot point being on the entering web centerline on a longitudinal axis of the angle bar at a location closer to the entering web than the first and second exiting web centerlines.

The present invention thus also provides a reversible angle bar for a web having an entering centerline, the device comprising an angle bar having a first position with a first exiting web centerline and a second reversed position with a second exiting web centerline coextensive with the first exiting web centerline, the reversible angle bar having a longitudinal axis and having an effective pivot point located on the longitudinal axis and on the entering web centerline closer to the entering web than the first and second exiting web centerlines.

The present invention also provides a method for changing a direction of a web exiting an angle bar device comprising the steps of: sending a web having an entering web centerline over an angle bar device in a first position and exiting the web at a first exiting web centerline, the first exiting web centerline being at an angle to the entering web centerline; changing the first position of the angle bar device to a second position; and sending the web at the entering web centerline over the angle bar device in the second position and exiting the web at a second exiting web centerline, the second web centerline being at another angle to the entering web centerline.

BRIEF DESCRIPTION OF THE DRAWINGS

An exemplary embodiment of the present invention will be further clarified with respect to the following drawings in which.

DETAILED DESCRIPTION

Figure 1:
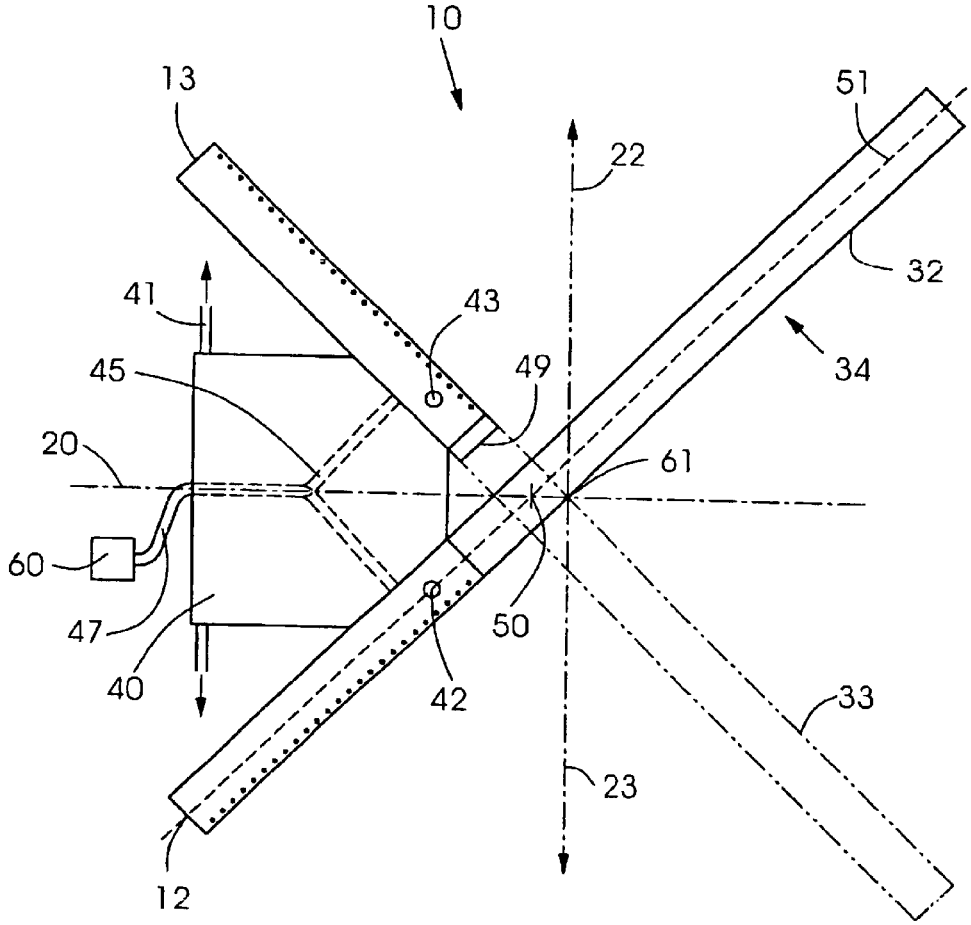
FIG. 1 shows the angle bar of the present invention in a first position and the alternate second reversed position.
Figure 2:
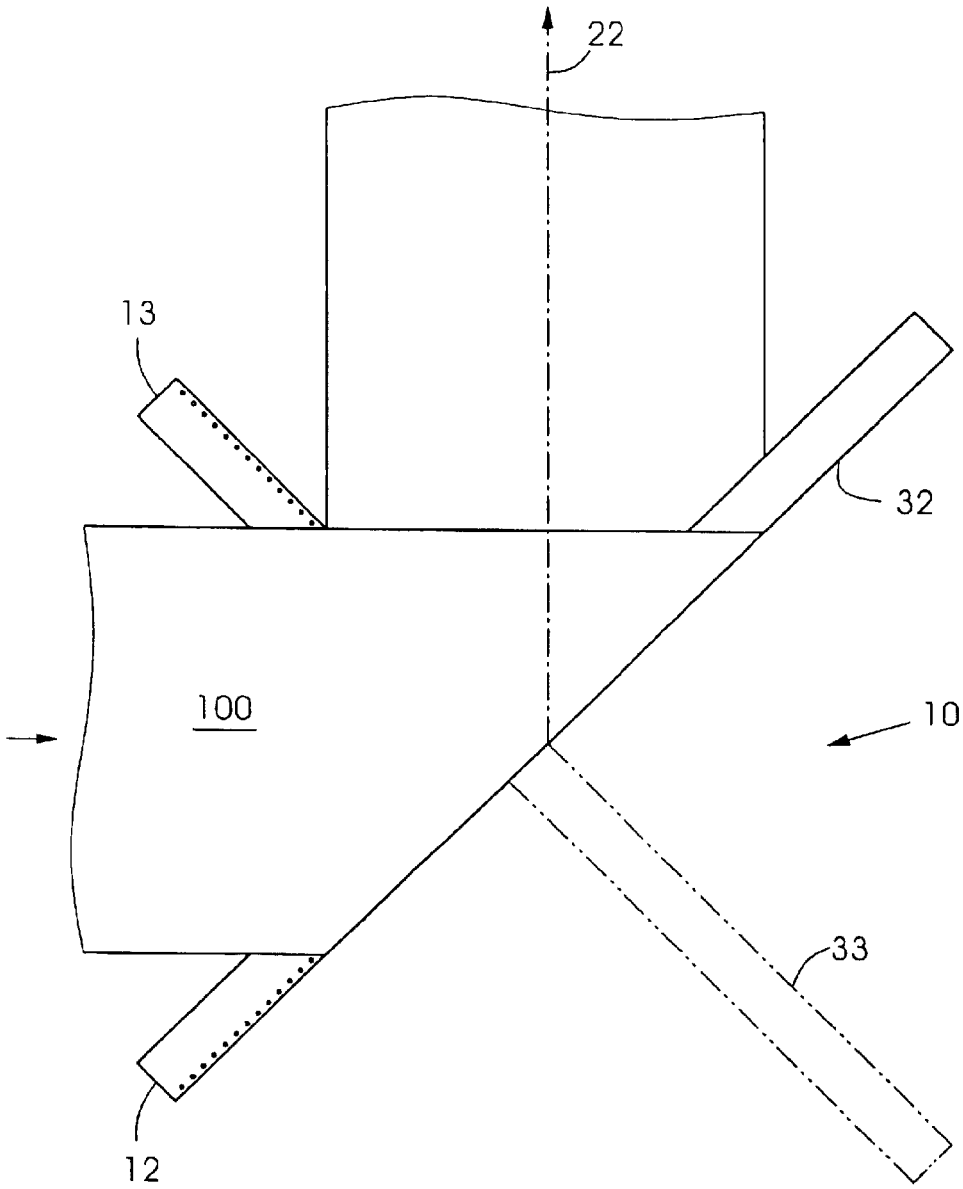
FIG. 2 shows a first operating position of the angle bar of FIG. 1.

FIG. 1 shows a preferred embodiment of a reversible angle bar device 10 for a web with an entering web centerline 20. Angle bar device 10 includes a support 40 with an air supply 60. Support 40, which may be a sliding carriage on a track 41, fixedly supports an angle bar portion 12 angled with respect to the entering web centerline 20 on a first side of the entering web centerline. Support 40 may be a plate narrower than an outer diameter of portion 12, and may pass through a slit in the bar portion 12 and be connected by an interior bolt 42 in a sealing manner. The support 40 thus does not interfere with web travel. Air from air supply 60 can pass through a flexible tube 47 to a Y-shaped air passageway 45 in support 40 to provide air to angle bar portion 12.

Support 40 also fixedly supports a second angle bar portion 13, in a similar manner to the support for bar portion 12, via a bolt 43. Second angle bar portion 13 is angled with respect to the entering web centerline 20 and is located on a second side of the entering web centerline opposite the first side. Air may also pass through passageway 45 from supply 60 to portion 13. A removable end cap 49 may prevent air from exiting the end of the second angle bar portion 49.

A moveable angle bar portion 32 is selectively attachable to either the first angle bar portion 12 (as shown in FIG. 1) or to the second angle bar portion 13, in which case the movable angle bar portion 32 is located in position 33 indicated by a dotted line in FIG. 1.

The entering web centerline 20 can remain the same with respect to the support for either position. As shown in FIG.

Figure 3:
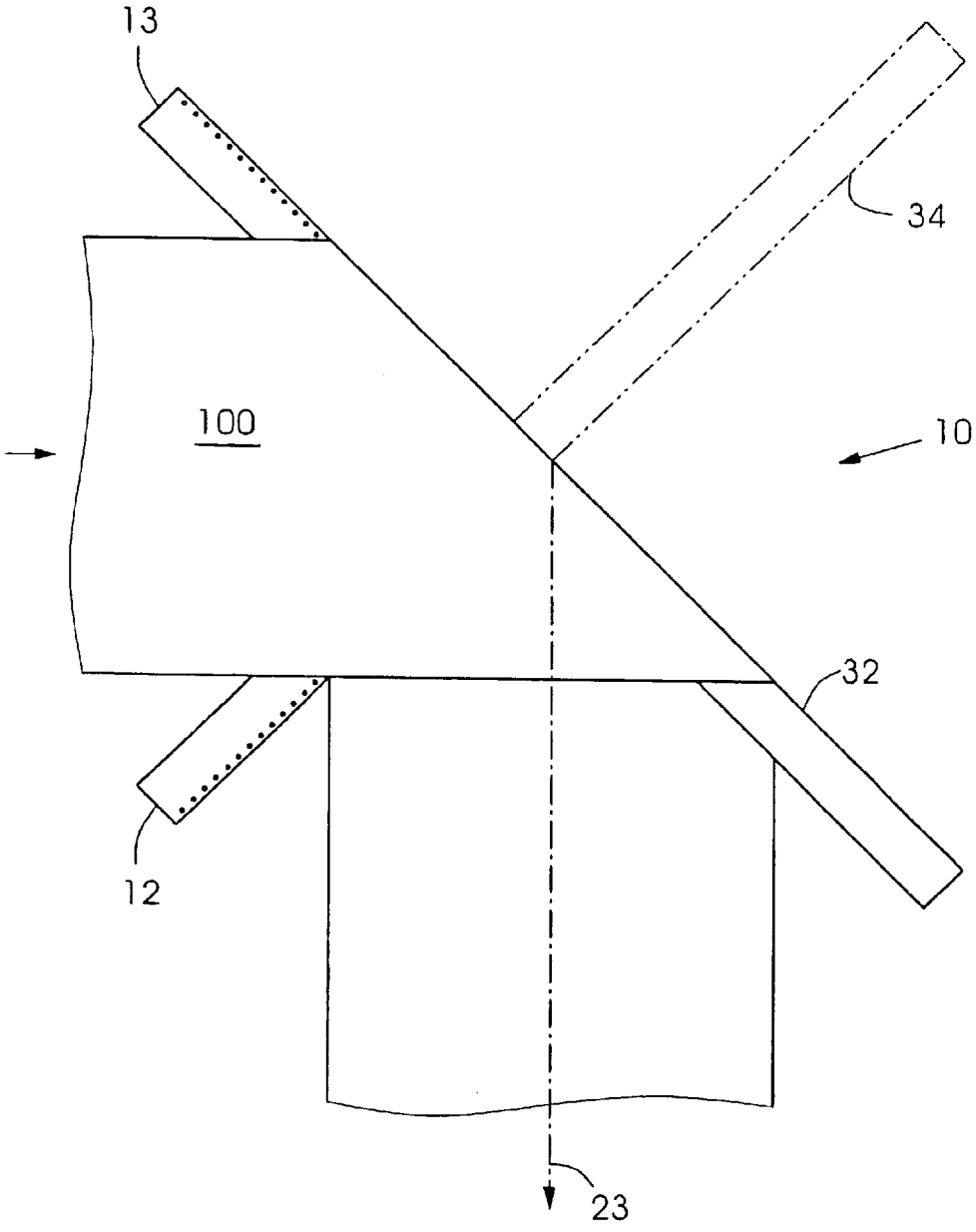
FIG. 3 shows a second operating position of the angle bar of FIG. 1.

2, when the angle bar portion 32 is connected to first angle bar portion 12, the web 100 exits the angle bar device 10 with a centerline 22. When the angle bar portion 32 is connected to second angle bar portion 12, the web 100 exits the angle bar device 10 with a centerline 23, as shown in FIG. 3. The previous position 34 of the angle bar portion 32 thus is vacant.

Centerlines 22 and 23 can be coextensive as shown in FIG. 1. Also as shown in FIG. 1, the two positions of the angle bar device 10 thus define an effective pivot point 50 of the angle bar device 10. However in the preferred embodiment, there is no actual pivot at point 50, as this would interfere with travel of the web 100.

The pivot point 50 advantageously is on the entering web centerline 20 on a longitudinal axis 51 of the angle bar portion 32 at a location closer to the entering web than the first and second exiting web centerlines 22, 23, i.e. pivot point 50 is closer to the entering web than location 60.

Preferably, the first angle bar portion 12 has an angle of 45 degrees to the entering web centerline, as does the second angle bar portion 13, the first and second angle bar portions 12, 13 thus being angled at 90 degrees to one another. The first and second angle bar portions 12, 13 preferably are symmetric to one another about the entering web centerline 20.

Figure 4:
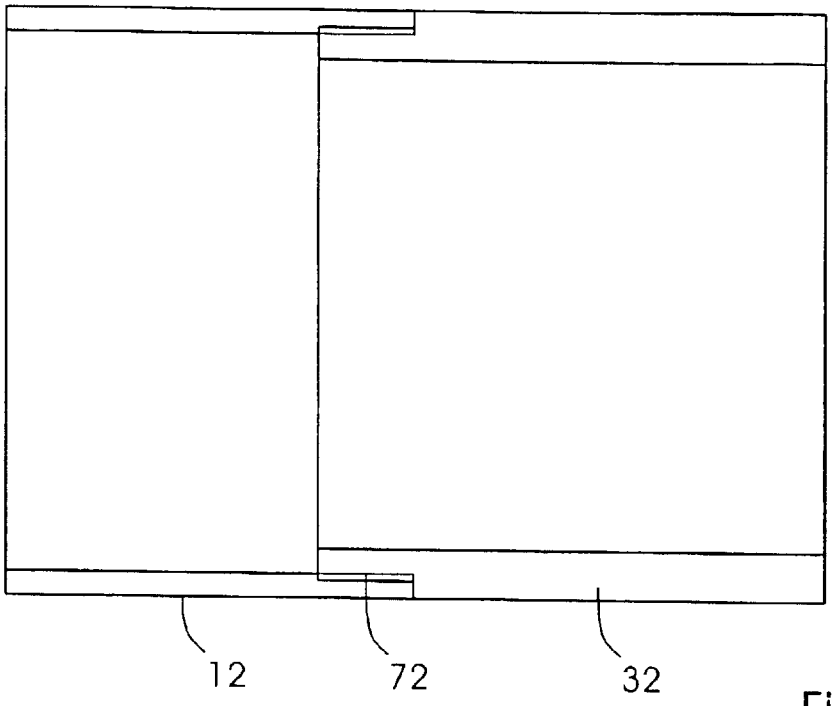
FIG. 4 shows a screw fit of the movable angle bar portion with one of the first or second angle bar portions.
Figure 5:
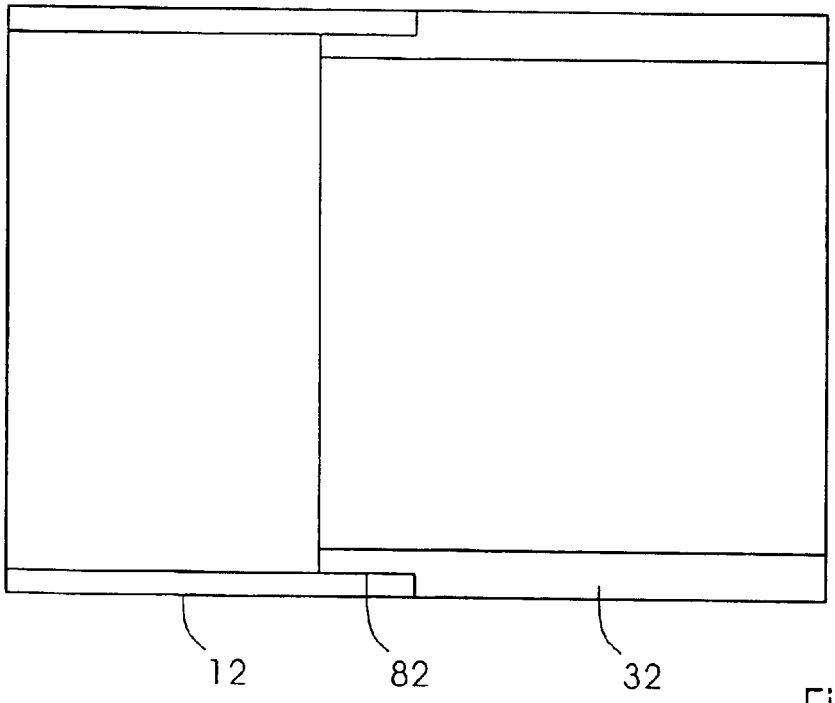
FIG. 5 shows an alternate slide fit to the FIG. 4 configuration.

The moveable angle bar portion 32 may be attached to either the first or second angle bar portions 12, 13 in an air-tight manner. FIG. 4 for example shows angle bar portion 32 connected to first angle bar portion 12 with a screw fit 72, while FIG. 5 shows a sliding fit 82.

Figure 6A:
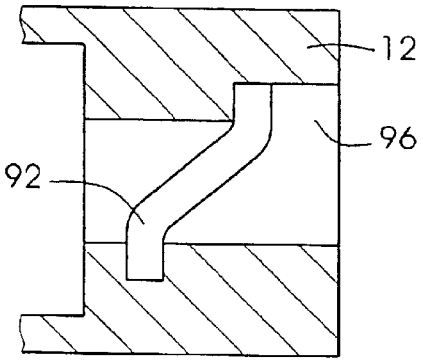
FIGS. 6A, 6B, 6C, 6D, 6E and 6F show an alternate half-turn self-locking fit to the FIGS. 4 and 5 configurations.
Figure 6B:
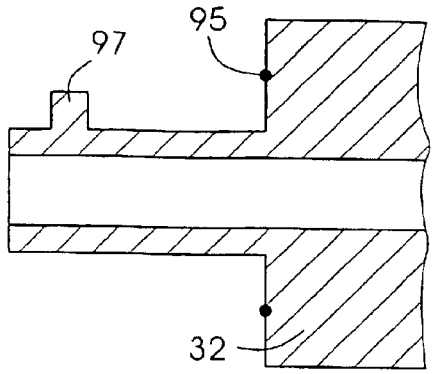
Figure 6C:
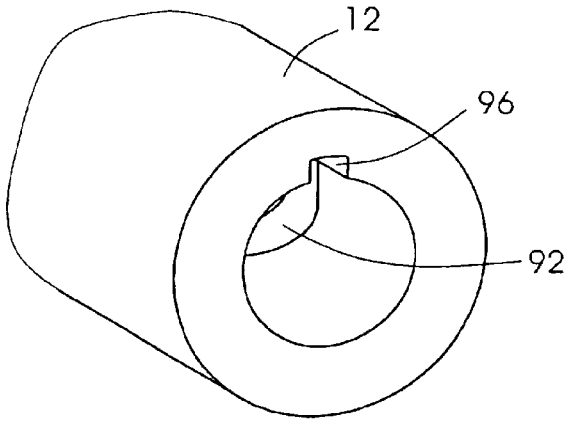
Figure 6D:
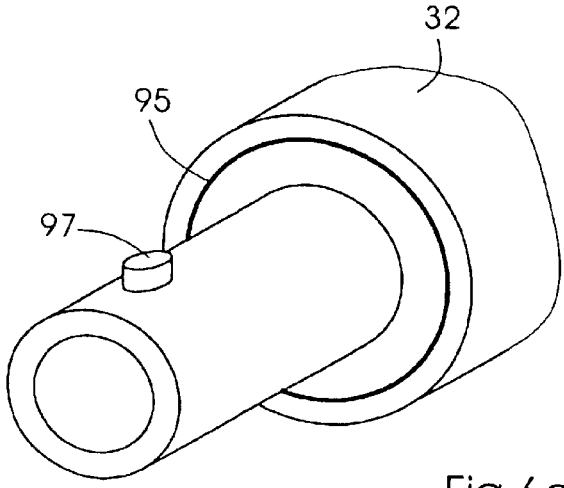
Figure 6E:
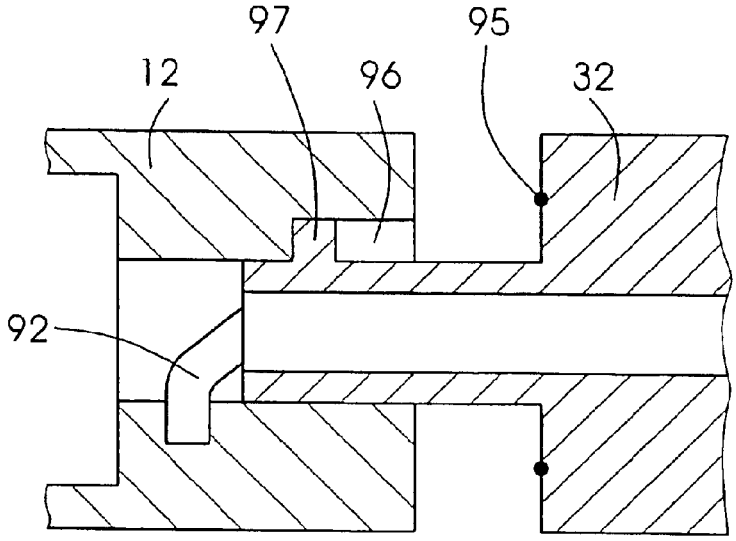
Figure 6F:
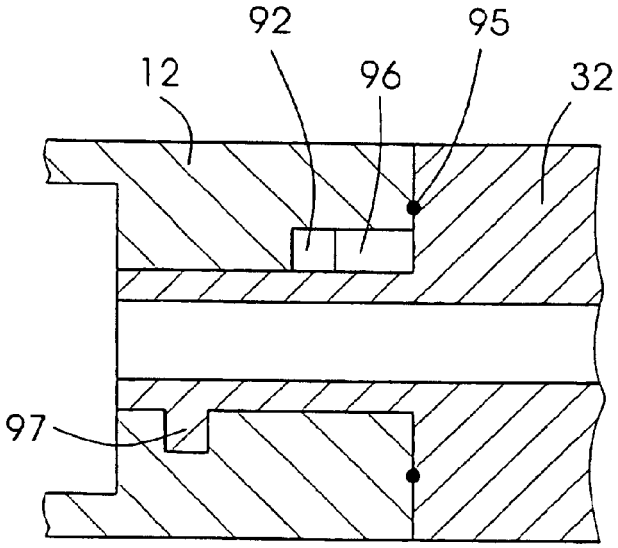

FIGS. 6A to F show schematically an alternate attachment mechanism with a half-turn. A pin 97 on a reduced circumference end of the moveable angle bar portion 32 may fit into a cut-out 96 of the angle bar portion 12 until a groove 92 in an inner side of the portion 12 is reached, as shown in FIG. 6E. With a half turn of the portion 32, the groove 92 forces pin 97 to move portion 32 toward angle bar portion 12, until a seal ring 95 is forced together between the portions 12 and 32, as shown in FIG. 6F.

End cap 49 (FIG. 1) can be placed on angle bar portion 12 when movable portion 32 is attached to angle bar portion 13, as in FIG. 3.

Support 40, together with the portions 12, 13, may be movable along track 41 to alter the web entering centerline 20. Support 40 thus may be a sliding carriage.

To change the web between the two positions, the web is stopped, the moveable portion 32 changed to the other portion 12, 13, and the web rerouted.

What is claimed is:

1. A reversible angle bar device for a web printing press having a web with an entering web centerline comprising:

a support, a first angle bar portion angled with respect to the first entering web centerline on a first side of the entering web centerline, a second angle bar portion angled with respect to the entering web centerline and being located on a second side of the entering web centerline opposite the first side, the first and second angle bar portions being fixed to the support, and a moveable angle bar portion selectively attachable to either the first angle bar portion or the second angle bar portion.

2. The device as recited in claim 1 wherein the first and second angle bar portions have an angle of 45 degrees to the entering web centerline.

3. The device as recited in claim 1 wherein the first and second angle bar portions are symmetric to one another about the entering web centerline.

4. The device as recited in claim 1 wherein the moveable angle bar portion is connected to either the first or second angle bar portion by an air-tight attachment.

5. The device as recited in claim 4 wherein the air-tight attachment is one of a sliding fit, a screw fit, or a self-locking mechanism.

6. The device as recited in claim 1 further comprising an air supply connected to both the first and the second angle bar portions.

7. The device as recited in claim 1 wherein the support is movable.

8. A reversible angle bar device for a web having an entering centerline, the device comprising:

a movable angle bar portion having a first position with a first exiting web centerline and a second reversed position with a second exiting web centerline coextensive with the first exiting web centerline, the movable angle bar portion having a longitudinal axis and having an effective pivot point located on the longitudinal axis and on the entering web centerline closer to the entering web than the first and second exiting web centerlines.

9. A method for changing a direction of a web exiting an angle bar device comprising the steps of:

sending a web having an entering web centerline over an angle bar device in a first position and exiting the web at a first exiting web centerline, the first exiting web centerline being at an angle to the entering web centerline;

changing the first position of the angle bar device to a second position; and sending the web over the angle bar device in the second position so as to have a same entering web centerline as the entering web centerline in the first position and exiting the web at a second exiting web centerline, the second exiting web centerline being at another angle to the entering web centerline.

10. The method as recited in claim 9 wherein the changing step includes moving a movable portion of the angle bar device between two fixed angle bar portions.

11. The method as recited in claim 9 wherein the first and second exiting web centerlines are coextensive.

12. The method as recited in claim 9 wherein the angle between the first exiting web centerline and the entering web centerline is 90 degrees.

* * * * *